US007125514B2

(12) United States Patent
Okamura et al.

(10) Patent No.: US 7,125,514 B2
(45) Date of Patent: Oct. 24, 2006

(54) PROCESS FOR PRODUCING REINFORCING SIC FIBER FOR SIC COMPOSITE MATERIAL

(75) Inventors: Kiyohito Okamura, Osaka (JP); Masaki Narisawa, Osakasayama (JP); Masaki Nishioka, Nabari (JP); Takaaki Dohmaru, Kawachinagano (JP); Kunio Oka, Sakai (JP); Yutai Katoh, Otsu (JP); Akira Kohyama, Kyoto (JP)

(73) Assignee: Japan Science and Technology Corporation, Saitama-ken (JP)

( * ) Notice: Subject to any disclaimer, the term of this patent is extended or adjusted under 35 U.S.C. 154(b) by 594 days.

(21) Appl. No.: 10/416,967

(22) PCT Filed: Nov. 13, 2001

(86) PCT No.: PCT/JP01/09914

§ 371 (c)(1),
(2), (4) Date: May 16, 2003

(87) PCT Pub. No.: WO03/027367

PCT Pub. Date: Apr. 3, 2003

(65) Prior Publication Data

US 2004/0013876 A1 Jan. 22, 2004

(30) Foreign Application Priority Data

Sep. 19, 2001 (JP) ..... 2001-284704

(51) Int. Cl.
*B29C 47/00* (2006.01)
*C04B 35/00* (2006.01)

(52) U.S. Cl. ..... 264/624; 264/625; 264/627; 264/638

(58) Field of Classification Search .....
264/211.12–211.15, 211.18, 624–625, 627, 264/638; 528/10, 33
See application file for complete search history.

(56) References Cited

U.S. PATENT DOCUMENTS

| | | | | |
|---|---|---|---|---|
| 4,737,552 | A | 4/1988 | Baney et al. | |
| 5,138,080 | A * | 8/1992 | Jung et al. | 556/430 |
| 5,278,110 | A * | 1/1994 | Toreki et al. | 501/88 |
| 5,792,416 | A * | 8/1998 | Sacks et al. | 264/625 |
| 6,069,102 | A * | 5/2000 | Sacks | 501/95.1 |
| 6,103,178 | A * | 8/2000 | Bujalski et al. | 264/470 |
| 6,342,269 | B1 * | 1/2002 | Yoshida et al. | 427/255.12 |

FOREIGN PATENT DOCUMENTS

| | | |
|---|---|---|
| DE | 42 14 045 A1 | 11/1993 |
| EP | 51855 A | 5/1982 |
| JP | 51-149925 A | 12/1976 |

* cited by examiner

*Primary Examiner*—Carlos Lopez
(74) *Attorney, Agent, or Firm*—The Webb Law Firm

(57) ABSTRACT

A mixed polymer liquid is prepared by mixing a polycarbosilane-dissolved organic solvent with poly(methylsilane) and moderated to viscosity of 5–20 Pa·s by heat-treatment to promote partial cross-linking reaction. The mixed-polymer is then melt-spun to fiber at 250–350° C. The fiber is cured by treatment at 100–200° C. in an oxidizing atmosphere, and baked at 1000° C. or higher. Due to thermosetting action of poly(methylsilane), the mixed polymer liquid is continuously melt-spun without breakage, and SiC fiber produced in this way is useful for reinforcement of SiC composite excellent in toughness, strength and heat-resistance.

4 Claims, No Drawings

PROCESS FOR PRODUCING REINFORCING SIC FIBER FOR SIC COMPOSITE MATERIAL

BACKGROUND OF THE INVENTION

1. Field of the Invention

The present invention relates to a method of manufacturing SiC fiber for reinforcement of SiC composite useful as structural members or parts of a power generating plants, aircraft, spacecraft machine, nuclear reactors, nuclear fusion reactors or the like driven under extremely severe conditions with heavy thermal duty.

2. Description of the Related Art

Various ceramics such as SiC and $Si_3N_4$ good of heat-resistance, corrosion-resistance and mechanical strength have been developed so far for structural members or parts of aircraft, spacecraft, nuclear reactors or the like driven under extremely severe conditions. Such ceramics are also used as parts of heat exchangers or mechanical seals driven with heavy duty.

Especially, SiC is a suitable material in various industrial fields from aerospace to nuclear power generation, due to its excellent resistance to heat, abrasion and corrosion as well as chemical stability. SiC is brittle itself, despite of good high-temperature property with a sublimation temperature higher than 2600° C. In order to overcome poor toughness, there are reports on reinforcement of SiC composite with SiC fibers, and various processes such as hot-press and liquid-phase sintering have been proposed for manufacturing SiC fiber-reinforced SiC-matrix composite.

SiC fiber for reinforcement of SiC composite has been prepared from polycarbosilane by a melt-spinning process capable of producing flexible fiber with ease compared with CVD process. The melt-spinning process relies on spinnability and formability of polycarbosilane as a pyrolyzed product of polysilane to a great extent, and enables formation of uniform fine structure free from any fluctuations originated in deviation of a Si/C ratio by baking. Uniformity of the fine structure means that there are no inhibitors against crystal growth and crack propagation. In the uniform structure derived from polycarbosilane, further improvement on physical property, especially heat-resistance of the fiber itself, however, cannot be expected any more.

Spinnability and high-temperature stability of polycarbosilane can be controlled by addition of a metal alkoxide or the like as a spinning aid. A representative metal alkoxide is poly-titano-carbosilane. However, generation of fine structure is derived from precipitation of a secondary phase at a high temperature, so that the fine structure substantially varies in response to a heating temperature and an atmosphere for heat-treatment in addition to presence of a metal alkoxide.

Coarsening of fine structure means fluidization of various grain boundaries in SiC fiber, and causes decrease of heat-resistance, resulting in poor quality reliability of SiC composite. Furthermore, inclusion of foreign elements other than C and Si from a spinning aid accelerates generation of a secondary phase at grain boundaries and put harmful influences on properties of SiC fiber.

SUMMARY OF THE INVENTION

The present invention aims at production of SiC fiber useful for reinforcement of SiC composite good of heat-resistance, toughness, strength and elasticity, by addition of poly(methylsilane) as a kind of a thermosetting agent to polycarbosilane without necessity of any spinning aid.

In the newly proposed method of producing SiC fiber, a melt is prepared by mixing a polycarbosilane-dissolved organic solvent with poly(methylsilane). The melt is moderated to a mixed polymer liquid with viscosity of 5–20 Pa·s by heat-treatment to promote partial cross-linking reaction. The mixed polymer liquid is melt-spun to fiber at 250–350° C. The fiber is cured by heat-treatment at 100–200° C. in an oxidizing atmosphere, and then baked at 1000° C. or higher in an inert gas atmosphere.

PREFERRED EMBODIMENTS OF THE INVENTION

Poly(methylsilane) is a kind of polysilanes, which has a main chain comprising repeated units of Si—Si, with a Si/C ratio of exactly 1 and includes a lot of Si—H groups good of chemical reactivity. Poly(methylsilane) is liquid at an ambient temperature and also compatible with various kinds of organic solvents. Accounting these features, applicability of poly(methylsilane) to a stoichiometric (in other words, chemically pure) SiC precursor has been researched so far.

The inventors have researched and examined on cross-linking reaction of poly(methylsilane) under controlled conditions such as heat-treatment or radiation cross-linking, and also investigated effects of cross-linking on ceramization of poly(methylsilane) in the succeeding step. In the course of the researches, it is discovered that poly(methylsilane) exhibits thermosetting action in a specified temperature region or in a specified atmosphere. Researches on crystalline structure of ceramics produced from poly(methylsilane) with a high cross-linking degree prove that a ratio of a single-Si phase is intensified in addition to SiC.

Based on the results of the researches and examination, the inventors have recognized the possibility to optimize properties of a polycarbosilane liquid mixed with poly (methylsilane) by controlling activity of poly(methylsilane) in a liquid phase. In fact, cross-linking reaction of a polymer is accelerated by addition of poly(methylsilane), and a mixed polymer liquid is moderated to viscosity of 5–20 Pa·s appropriate for melt-spinning. Poly(methylsilane) contains Si at a relatively higher ratio than polycarbosilane without inclusion of impurities other than Si. Consequently, silicon carbide SiC produced from the mixed polymer liquid is amorphous free from impurities, and compositional fluctuation at a nanometer level can be expected.

Poly(methylsilane) is preferably added to polycarbosilane at a ratio of 0.2–1.0 mass % in order to attain viscosity of 5–20 Pa·s. A mixed polymer liquid with viscosity adjusted to 5–20 Pa·s can be melt-spun to SiC fiber of 5–15 μm in diameter at a temperature of 100–200° C. by a pinhole-type extrusion spinner or the like. When the SiC fiber is heated at 100–200° C. in an oxidizing atmosphere, many cross-linking points are generated in the SiC fiber. Consequently, the SiC fiber becomes resistant to softening during high-temperature baking (i.e. curing). The cured SiC fiber is converted into ceramic fiber superior in strength, elasticity, heat-resistance and toughness, by pyrolysis at 1000° C. or higher in an inert gas atmosphere.

Continuous spinning is enabled by moderating a mixed polymer liquid to viscosity of 5–20 Pa·s. Since the viscosity is determined in relation with balance of a molten phase with a cross-linking degree, the mixed polymer liquid is conditioned to viscosity of 5–20 Pa·s by heat-treatment at 250–350° C.

Macromolecules for construction of SiC fiber are firmly bonded each other by insertion of oxygen atoms during curing, so as to inhibit softening or deformation of SiC fiber being baked at a higher temperature. Insertion of oxygen atoms is realized by heat-treatment at 100–200° C. in an oxidizing atmosphere.

The cured SiC fiber exhibits physical properties depending on baking conditions such as a heating temperature and an atmosphere in addition to composition. Effects of the baking conditions are originated in changes of composition, density and structure of SiC fiber at its outermost layer in response to variation of a pressure ratio of CO to SiO in an oven during pyrolysis. Baking at a temperature of 1000° C. or higher in an inert gas atmosphere is favorable for production of SiC fiber, due to stabilized partial pressures of CO and SiO.

The mixed polymer liquid is conditioned to composition bestowed with slight ununiformity. Due to the slight ununiformity, propagation of cracks and crystal growth to coarse grains are suppressed, and SiC fiber as a final product is improved in fracture toughness, elasticity, fracture elongation and heat-resistance.

EXAMPLE

A mixed polymer liquid was prepared as follows: Poly (methylsilane) was added to polycarbosilane-dissolved tetrahydrofuran (an organic solvent) at a certain ratio. After poly(methylsilane) was uniformly dispersed in the organic solvent by stirring for 2 hours, the organic solvent was removed from the polymeric mixture by distillation. The polymeric mixture was further heated up to 600K. in an inert gas atmosphere for 2.5 hours and held in molten state at 600K. for additional 2 hours in order to promote self-organization.

The mixed polymer liquid was directly spun as such to SiC fiber through a pin hole of a melt-spinner. The SiC fiber was oxidized and cured by heat-treatment at about 450 K. in an oxidizing atmosphere. The cured SiC fiber was baked at 1273 K. and further annealed at 1573 K. in an inert gas atmosphere.

Each SiC fiber was examined by a tensile test, to research effects of poly(methylsilane) on strength and elasticity. Crystallite of the SiC fiber was observed by X-ray diffraction, and fine structure at a surface and cross-section of the SiC fiber was observed by a scanning electron microscope (SEM).

A polymer liquid mixed with poly(methylsilane) at 5 mass % was too viscous but not conditioned to viscosity capable of continuous melt-spinning, since polycarbosilane was excessively cross-linked during melt-spinning.

A polymer liquid mixed with poly(methylsilane) at 0.5 or 1 mass % was conditioned to viscosity capable of continuous melt-spinning under nearly the same conditions as for polycarbosilane, and melt-spun to SiC fiber without breakage as compared with melt-spinning of sole polycarbosilane. When the SiC fiber was baked at 1573 K., it was bestowed with good properties necessary as a reinforcing element, as shown in Table 1. Especially, big effects of poly(methylsilane) on tensile strength and elasticity were noted at a ratio of 0.5 mass %, and tensile strength and elasticity were 1.1 and 1.2 times high, respectively, as those of SiC fiber produced in absence of poly(methylsilane).

Addition of poly(methylsilane) to polycarbosilane causes reduction of diameter of SiC fiber and slight volumetric increase of crystallite in size measured by X-ray diffraction. Results of SEM observation proved that SiC fiber was smooth at its surface and fracture plane without any special change of shape regardless presence or absence of poly (methylsilane). It is understood from the smooth surface that SiC fiber without misgivings about decrease of strength caused by surface defects was produced under the above-mentioned conditions.

TABLE 1

Effects of Poly(methylsilane) on Spinnability and Propeties of SiC Fiber

| Example No. | 1 | 2 | 3 | 4 |
|---|---|---|---|---|
| a ratio (mass %) of poly(methylsilane) | 0 | 0.5 | 1.0 | 5 |
| viscosity (Pa · s) | 10 | 10 | 20 | 30 |
| spinnability | spinable | without breakage | without breakage | un-spinnable |
| a baking temperature (K) | 1573 | 1573 | 1573 | — |
| tensile strength (GPa) | 2.19 | 2.42 | 2.30 | — |
| elasticity (GPa) | 179.2 | 224.0 | 192.9 | — |

A polymer liquid in absence of poly(methylsilane) was continuously melt-spun, but SiC fiber was sporadicaliy broken due to a little bit lower viscosity.

INDUSTRIAL APPLICABILITY OF THE INVENTION

According to the present invention as above-mentioned, a mixed polymer liquid, which is prepared by blending polycarbosilane with poly(methylsilane) to increase cross-linking reactivity of the polymer, can be melt-spun with good spinnability and formability without necessity of any spinning aid. Since the SiC fiber is bestowed with compositional fluctuations at a nanometer level by addition of poly(methylsilane), its toughness, strength and heat-resistance are increased to values necessary for a reinforcing element. Consequently, SiC composite having the SiC fiber distributed in SiC matrix is useful as structural members or parts of power generators, aircraft, spacecraft, nuclear reactors, nuclear fusion reactors or the like driven under extremely severe conditions, due to excellent properties of the SiC fiber.

The invention claimed is:

1. A method of manufacturing SiC fiber useful for reinforcement of SiC composite, which comprises the steps of:

preparing a mixed polymer liquid by adding poly(methylsilane) to a polycarbosilane-dissolved organic solvent;

moderating said mixed polymer liquid to viscosity of 5–20 Pa·s by heat-treatment to promote partial cross-linking reaction;

melt-spinning said moderated polymer liquid to fiber;

curing said fiber by heat-treatment in an oxidizing atmosphere; and baking said cured fiber at a temperature of 1000° C. or higher in an inert gas atmosphere.

2. The method according to claim 1, wherein said moderated polymer liquid to fiber is melt-spinned at about 250–350° C.

3. The method according to claim 1, wherein said fiber is cured at about 100–200° C.

4. The method according to claim 1, wherein poly(methylsilane) is added to the polycarbosilane-dissolved organic solvent at a ratio of about 0.2–1.0 mass %.

* * * * *